United States Patent [19]

White, Jr.

[11] Patent Number: 4,780,969

[45] Date of Patent: Nov. 1, 1988

[54] ARTICLE OF FOOTWEAR WITH IMPROVED TENSION DISTRIBUTION CLOSURE SYSTEM

[76] Inventor: Samuel G. White, Jr., 5707 Hartford Dr., Ft. Wayne, Ind. 46835

[21] Appl. No.: 80,109

[22] Filed: Jul. 31, 1987

[51] Int. Cl.[4] ..... A43B 11/00

[52] U.S. Cl. ..... 36/50; 36/114; 24/117

[58] Field of Search ..... 36/50, 51, 114, 97; 24/117, 119, 140, 141

[56] References Cited

U.S. PATENT DOCUMENTS

| | | | |
|---|---|---|---|
| 1,224,390 | 5/1917 | Lipinski | 36/50 |
| 2,539,761 | 1/1951 | Whitman | 36/114 |
| 2,643,469 | 6/1953 | Herceg | 36/50 |
| 2,994,972 | 8/1961 | Blair | 36/113 |
| 4,081,916 | 4/1978 | Salisbury | 36/50 |
| 4,413,431 | 11/1983 | Cavanagh | 36/50 |
| 4,553,342 | 11/1985 | Derderian et al. | 36/50 |
| 4,559,723 | 12/1985 | Hamy et al. | 36/114 |
| 4,571,782 | 2/1986 | Ahn | 24/117 |

*Primary Examiner*—Steven N. Meyers

*Attorney, Agent, or Firm*—H. Kenneth Johnston, II

[57] ABSTRACT

A shoe with an improved tension distribution closure system is disclosed. The system is accomplished by increased spacing of eyelets, and decreasing the adjacent row spacing in the lower portion of the shoelace and decreasing the spacing of eyelets and increasing adjacent row spacing in the upper portion of the shoelace opening.

3 Claims, 1 Drawing Sheet

ARTICLE OF FOOTWEAR WITH IMPROVED TENSION DISTRIBUTION CLOSURE SYSTEM

TECHNICAL FIELD

This invention relates to an improved tension distribution closure system for an article of footwear. The closure system is particularly adapted for use on all laced footwear.

BACKGROUND OF THE INVENTION

The present day shoe is made up of a combination of many materials, however, they all have the same basic lace fastening mechanism. Various attempts have been made to provide speed lacing such as Salisbury, U.S. Pat. No. 4,081,916 which provides for a "Velcro" type fastener to tighten the laces with a single patch of fabric. Although Salisbury provides for a means for quickly tightening the laces, the tightening means has the same drawback as do all other lacing mechanisms, that is there is poor tension distribution over the lacing means causing pain to the instep of the foot. There have been various attempts to provide adjustable tension lacing means because of the intolerable pressure on the instep of the foot. Derderian, U.S. Pat. No. 4,553,342 provides for a means of having a different tension at different positions of the lace, however, this does not eliminate the problem because each section has specific tension rather than each eyelet having its own tensioning and requires the user to adjust each section independently. The within invention eliminates the problem of having unbearable tension on the upper portion of the laced shoe and vertually no tension on the lower portion of the laced shoe. This problem is more prominent in athletic shoes because the athlete desires to have a snug fit to avoid blisters which is generated from a loose fit shoe.

The object of the within invention is to accomplish both the tensioning of the bottom part of the shoe eyelet providing a secure foot in the shoe and tensioning in the upper part of the shoe eyelets that is comfortable.

SUMMARY OF THE INVENTION

This invention relates to an article of footwear with improved lace tension distribution. The footwear includes an upper which surrounds the foot of the wearer and a sole attached to the upper for contacting the ground. The upper generally includes a tongue. The present system generally utilizes current technology, ie., the use of the eyelet for laceing a shoe. The present invention has the eyelet width distance larger near the toe and closer together nearer the tie point of the shoe. Similarily the distance between the eyelet rows increase as the eyelets near the tie point allowing generation of more tension on the lower portion of the foot without extreme pressures on the instep. The tension on the lower portion of the foot is increased 100 percent without any increase in the tension at the tie point, generally that being across the instep. The object of the invention is to provide a laceing system whereby the angle of the eyelets are such as to provide improved tension distribution over the conventional laced shoe.

DESCRIPTION OF THE PREFERRED EMBODIMENT

Figure 1:
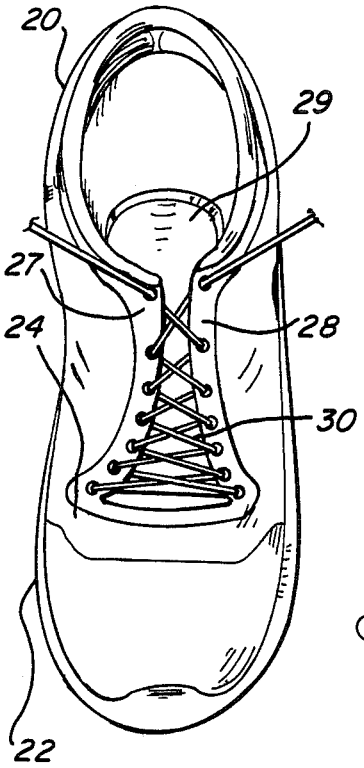
FIG. 1 is a front view of a conventional shoe embodying the invention.
Figure 2:
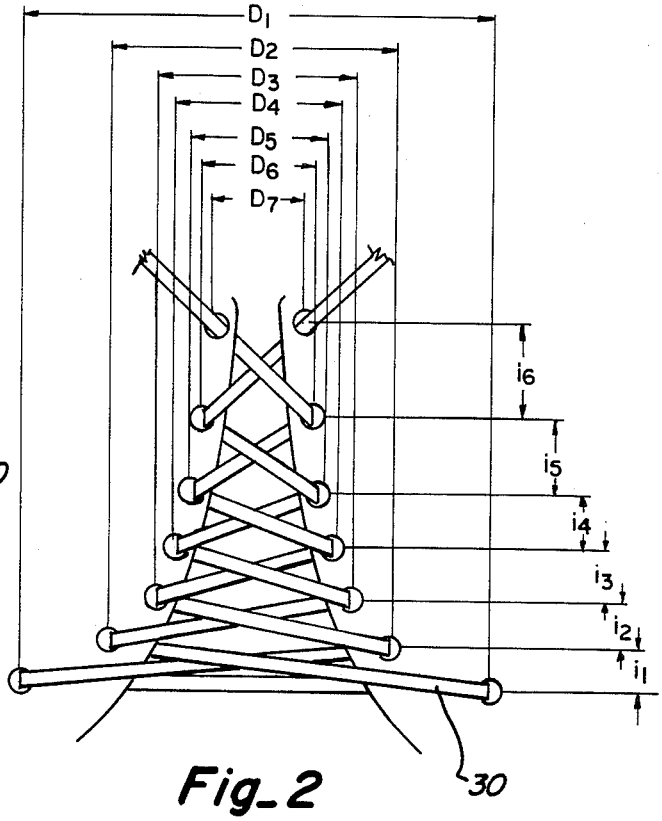
FIG. 2 is a front view of a conventional shoe laceing means embodying the invention.
Figure 3:
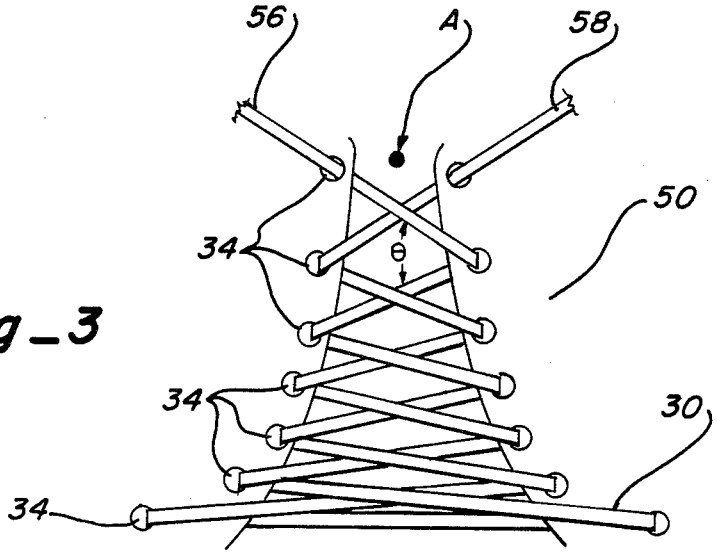
FIG. 3 is a front view of a conventional show laceing means embodying the invention having a foot inserted into the shoe.

An article of footwear in accordance with the present invention, such as an athletic shoe, is generally shown as 20. Athletic shoe 20 includes a sole 22, and an upper 24 attached to it. Upper 24 has opposing facing sides 27 and 28. A tongue 29 extends along and below opposing facing sides 27 and 28. The upper 24 is intended to be closed by a shoelace 30 threaded through the eyelets 34 of the tension distribution closure system 50. Eyelets 34 are incorporated along opposing faces 27 and 28 and are adapted to allow the free passage of a shoelace. The tension distribution closure system 50 has lacing means adjacent row spacing i, lacing means spacing D, and lace angle $\theta$ shown in FIG. 3. When a foot is inserted into shoe 20, the opposing faces 27 and 28 are spread apart however, the angle $\theta$ and the lacing means adjacent row spacing i remain substantially constant as shown in FIG. 3. The angle $\theta$ ranges from about 5° at the toe to about 55° at the tie point A.

In operation shoe lace 30 is tensioned at points 56 and 58 which causes opposing faces 27 and 28 to move toward each other with the lower portion of the opposing faces 27 and 28 traveling more distance than the upper portion of opposing faces 27 and 28 which allows for the more snug and comfortable fit of shoe 20.

$D_1$ through $D_7$ is the spacing between the eyelets 34 across the width of the shoe 20. $i_1$ through $i_7$ is the spacing between eyelets 34 along the length of the shoe 20. The lacing means spacing is specified as the spacing between opposing pairs of eyelets and the lacing means adjacent row spacing is specified as the spacing between adjacent eyelets residing on the medial or laterial sides of the tongue opening. The angle $\theta$ for the eyelets 34 at the toe end of the shoe 20 is reduced and 0 is increased at the tie portion of shoe 20 according to a logarithmic arrangement of $D_1$ through $D_7$ as well as a logarithmic spacing of the adjacent rows $i_1$ through $i_7$.

| RANGE | RANGE |
|---|---|
| $\frac{D_1}{D_2} = 1.37\text{–}2.05$ | $\frac{D_4}{D_5} = 0.95\text{–}1.41$ |
| $\frac{D_2}{D_3} = 0.99\text{–}1.47$ | $\frac{D_5}{D_6} = 1.04\text{–}1.54$ |
| $\frac{D_3}{D_4} = 1.13\text{–}1.69$ | $\frac{D_6}{D_7} = 0.92\text{–}1.38$ |
| $\frac{i_2}{i_1} = 0.92\text{–}1.38$ | $\frac{i_5}{i_4} = 1.13\text{–}1.69$ |
| $\frac{i_3}{i_2} = 0.95\text{–}1.41$ | $\frac{i_6}{i_5} = 1.04\text{–}1.54$ |
| $\frac{i_4}{i_3} = 0.99\text{–}1.47$ | $\frac{i_7}{i_6} = 1.37\text{–}2.05$ |

Further, the ratio of the eyelet widths $D_1$ through $D_7$ and the eyelet spacing $i_1$ through $i_7$ determine the pattern of the foot.

| RANGE | RANGE |
|---|---|
| $\frac{D_1}{i_1} = 18.96\text{–}28.44$ | $\frac{D_5}{i_5} = 2.32\text{–}3.48$ |
| $\frac{D_2}{i_2} = 9.60\text{–}14.40$ | $\frac{D_6}{i_6} = 1.39\text{–}2.07$ |
| $\frac{D_3}{i_3} = 5.79\text{–}8.67$ | $\frac{D_7}{i_7} = 0.709\text{–}1.063$ |
| $\frac{D_4}{i_4} = 3.65\text{–}5.47$ | |

Although the invention has been described with reference to a particular embodiment, it is to be understood that the same is merely illustrative of the principles involved and modifications may be made within the scope of the appended claims without deviating from the teachings of the invention.

What is claimed:

1. A tension distribution closure system for shoes comprising:

a shoe having medial and lateral adjacent closure faces along the tongue opening and lacing means comprising a plurality of eyelets in each of said closure faces adapted to permit a shoelace to pass freely therethrough; and having a lacing means spacing consisting of the spacing between opposing pairs of eyelets and a lacing means adjacent row spacing consisting of the spacing between adjacent eyelets residing on either the medial or lateral closure face of the tongue opening; and said lacing means spacing increasing in width as said lacing means nears the toe of said shoe; and said lacing means adjacent row spacing increasing near the tie point, providing greater tension at the toeward lacing means and greater tension distribution across the entire shoe when said shoelace is pulled and tied.

2. A tension distribution closure system as recited in claim 1 whereby said lacing means spacing is logarithmically arranged.

3. A tension distribution closure system as recited in claim 1 whereby said lacing means adjacent row spacing is logarithmically spaced.

* * * * *